US005772785A

United States Patent [19]

Schouten

[11] Patent Number: 5,772,785

[45] Date of Patent: Jun. 30, 1998

[54] MACHINE DISH-WASHING PROCESS

[75] Inventor: Cornelis Schouten, Rotterdam, Netherlands

[73] Assignee: Epenhuysen Chemie N.V., Zwijndrecht, Netherlands

[21] Appl. No.: 560,536

[22] Filed: Nov. 17, 1995

[30] Foreign Application Priority Data

Nov. 18, 1994 [NL] Netherlands ..... 9401932
Feb. 10, 1995 [NL] Netherlands ..... 9500254

[51] Int. Cl.[6] ..... B08B 3/02; B08B 5/00
[52] U.S. Cl. ..... 134/25.2; 134/26; 134/10
[58] Field of Search ..... 134/25.2, 10, 26

[56] References Cited

U.S. PATENT DOCUMENTS 3,188,146 6/1965 Cordes ..... 302/53

FOREIGN PATENT DOCUMENTS

| | | |
|---|---|---|
| 0 386 637 | 9/1990 | European Pat. Off. . |
| 0 611 843 | 8/1994 | European Pat. Off. . |
| 6 608 792 | 12/1967 | Netherlands . |
| 1149574 | 4/1969 | United Kingdom . |
| WO 82/00482 | 2/1982 | WIPO . |

*Primary Examiner*—Zeinab El-Arini
*Attorney, Agent, or Firm*—Young & Thompson

[57] ABSTRACT

Dish-washing process, in which a solid cleaning composition in powder form is distributed over crockery in such a manner that the surface of the crockery is completely or partially covered with the cleaning composition, and said powder-form cleaning composition, after distribution, is given an operational form, for example by means of contact with a solvent. The powder is preferably dispersed over crockery which has been moistened with water.

25 Claims, 4 Drawing Sheets

MACHINE DISH-WASHING PROCESS

FIELD OF THE INVENTION

The invention relates to a machine dish-washing process, in which crockery is treated in an intermediate or washing zone with a cleaning composition, particularly a highly concentrated cleaning composition. Crockery is understood to mean all objects to be cleaned in dish-washing machines, such as plates, saucers, cutlery, mugs, bowls, cups, dishes and the like. In particular, the invention relates to industrial (machine) dish-washing processes in which the crockery is taken through a "carwash" sequence. In this carwash sequence, the crockery successively passes through a series of different treatment sections in which the crockery undergoes a series of treatments with the cleaning composition, is rinsed and dried, respectively. Prior to treatment with the cleaning composition, the crockery may further be taken through one or more preliminary rinsing sections. However, the invention is not restricted thereto. The invention may also be applied in single-tank dishwashers, for domestic use, for example, or in installations for washing crates, for example.

BACKGROUND OF THE INVENTION

EP-A-0,406,682 describes a dish-washing process in which a highly concentrated, liquid cleaning composition is poured out over the crockery and the excess is collected and is processed for re-use.

It is claimed that, in this way, a saving in the consumption of cleaning composition is achieved. U.S. Pat. No. 2,910,391 describes the use of liquid cleaning compositions in which said cleaning composition is sprayed over the crockery and then rinsed off with water.

SUMMARY OF THE INVENTION

The subject of the present invention is an alternative dish-washing process by means of which disadvantages of known dish-washing processes can be remedied.

In this connection, it is proposed that the cleaning composition in solid form, such as a powder, is distributed, preferably dispersed, over the crockery in such a manner that the surface of the crockery is completely or partially covered with the cleaning composition, and that said powder-form cleaning composition is given an operational form, for example by means of contact with a solvent.

Preferably, the powder is given its operational form by being dissolved in water. For this purpose, the surface of the crockery may be covered in advance with a liquid film, applied, for example, in a preliminary rinsing zone, over which the powder is then distributed. The solvent may also be brought into contact with the crockery at any other suitable moment.

It has been found that, with the dish-washing process according to the invention, especially starch residues but also other food residues remaining on the crockery are reliably removed, whilst reliable and safe operation is guaranteed.

The fundamental insight underlying the invention is that the crockery is suitably brought into contact with a cleaning composition which, preferably, has a particularly intensive action when distributed, preferably dispersed, over the crockery in solid powder form. The distribution of solid, powder-form cleaning composition, from the standpoint of safety, is, compared with the distribution of liquid cleaning composition, more simple. Operating staff are exposed to a lower risk of contact with aggressive cleaning composition. Any leaks in conveyor lines or supply vessels will be less risky. There is also a concomitant environmental advantage. The dispersal of powder-form material has lower requirements in terms of the sealing of inlet shutters and the like. Storage and transportation of a powder-form cleaning composition is more straightforward. Consequently, an ergonomic advantage is achieved: there is less heavy lifting for operating staff. The amount of packaging material is also reduced. While the distribution of the cleaning composition is simplified, it is also possible to achieve a high concentration of one or more cleaning components on the crockery. For example, in the case of the cleaning (alkali) components, a concentration of 30% by weight or more can be obtained. With higher concentrations, a further advantage may be achieved, in that the washing temperature can be lowered whilst the constant washing effect is maintained.

Preferably, the powder is sprinkled over the crockery in such a manner that, once in operational form, one or more of the cleaning components of the cleaning composition have a concentration of at least 0.6% by weight, preferably in excess of 20% by weight.

Preferably, a cleaning composition based on an alkaline substance is used. Also when using substances with a cleaning action the powder is not rinsed off directly from the crockery. Other variants for sprinkling the water and dispersing the powder over the crockery at different moments are also possible.

It will be clear to the expert which particle size to choose for the powder in order to arrive at an optimum distribution over the crockery. It will also be clear to the expert how to make up the cleaning composition in powder form in order to achieve a desired cleaning action.

BRIEF DESCRIPTION OF THE DRAWINGS

The invention is further described below with reference to a non-limiting further illustrative embodiment based on the appended drawings. In the drawings.

DETAILED DESCRIPTION OF THE PREFERRED EMBODIMENTS

Figure 1:
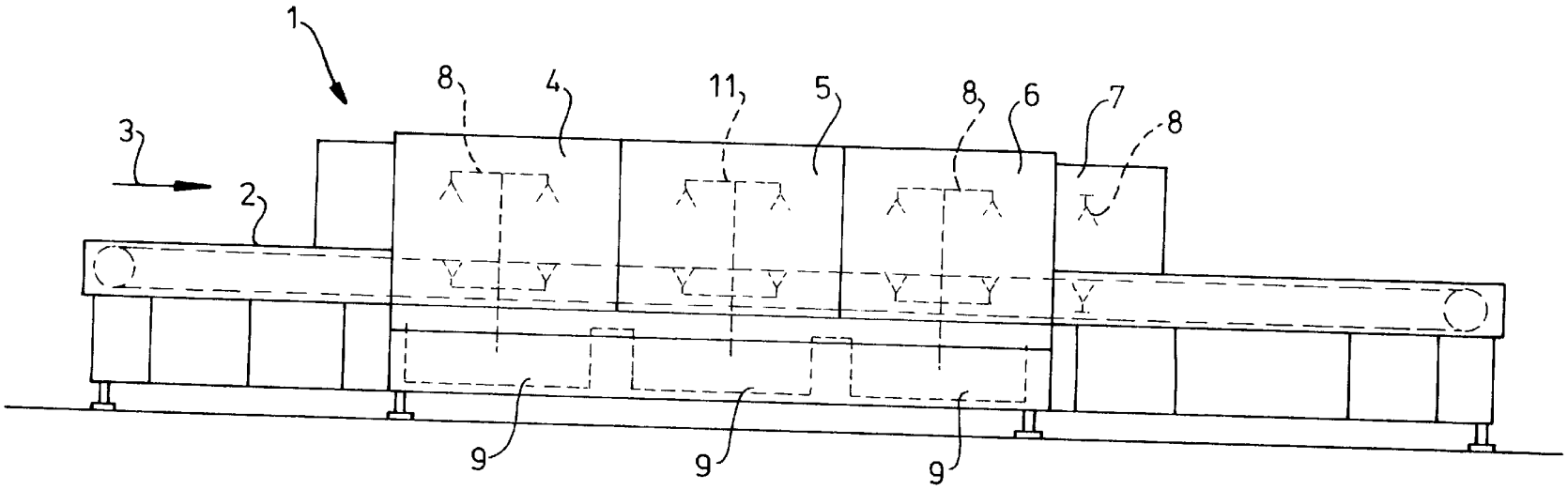
FIG. 1 shows diagrammatically in side view a machine belt dishwasher which is suitable for applying the present invention.

FIG. 1 diagrammatically shows a machine dish-washing machine 1. The crockery is brought into the dish-washing machine via a feed point 2. The crockery passes through the dish-washing machine in the direction of the arrow 3. The dish-washing machine 1 comprises sections 4, 5 and 6. In section 4, a preliminary washing of the crockery takes place, where the latter is rinsed off with warm water. The crockery is consequently moistened and the larger pieces of food residues are rinsed off. A very low concentration of cleaning composition may be dissolved, if appropriate, in the water in section 4. It is customary for the water used in section 4 to come from the further sections 5 and 6. In section 5, the powder-form cleaning composition is dispersed over the crockery. This is further described with reference to FIG. 2 and FIG. 3. In section 6, hot water at a temperature of, for example, 40°–70° C. is poured over the crockery, the water having dissolved in it cleaning composition originating from the powder-form cleaning composition deposited on the crockery in section 5. If appropriate, extra cleaning composition is added to the washing water in section 6. Section 6 is followed by a rinsing section 7 where the crockery is rinsed off with clean water and, if appropriate, a brightener is distributed over the crockery. If appropriate, a further drying section (not shown) may follow section 7. Sections 4, 6 and 7 contain spraying arms 8 for distributing the water over the crockery. Section 5 contains dispersing arms 11 for dispersing the powder-form cleaning composition. Under sections 4, 5 and 6 there is also a collecting tank 9 for collecting water and any excess of dispersed powder-form cleaning composition. Fluid from said tanks 9 is pumped up into sections 4 and 6 in the customary manner and is distributed over the crockery by means of the spraying arms 8. The tank 9 in section 6 is then filled up with water originating from section 7, while the tank 9 in section 4, optionally via the tank 9 in section 5, is filled up with fluid originating from the tank 9 in section 6. The tank 9 in section 4 has, furthermore, an overflow to the drainage system, for example. This so-called "cascade loop" of the water through the various tanks 9 in the direction opposite to the direction in which the crockery is moved forward through the dish-washing machine 1 is also known per se. It will be clear that the invention is not restricted to this type of dish-washing machine. Therefore, for example, the number of sections may vary from the example described here. The location of dispersal of the powder may also differ from that which is described here. For example, the powder may also be dispersed between sections 4 and 5. This is possible because an adequate washing result may be achieved with the powder in a very short contact time (approx. 1 sec.). The presence of a cascade loop is also non-essential.

Figure 2:
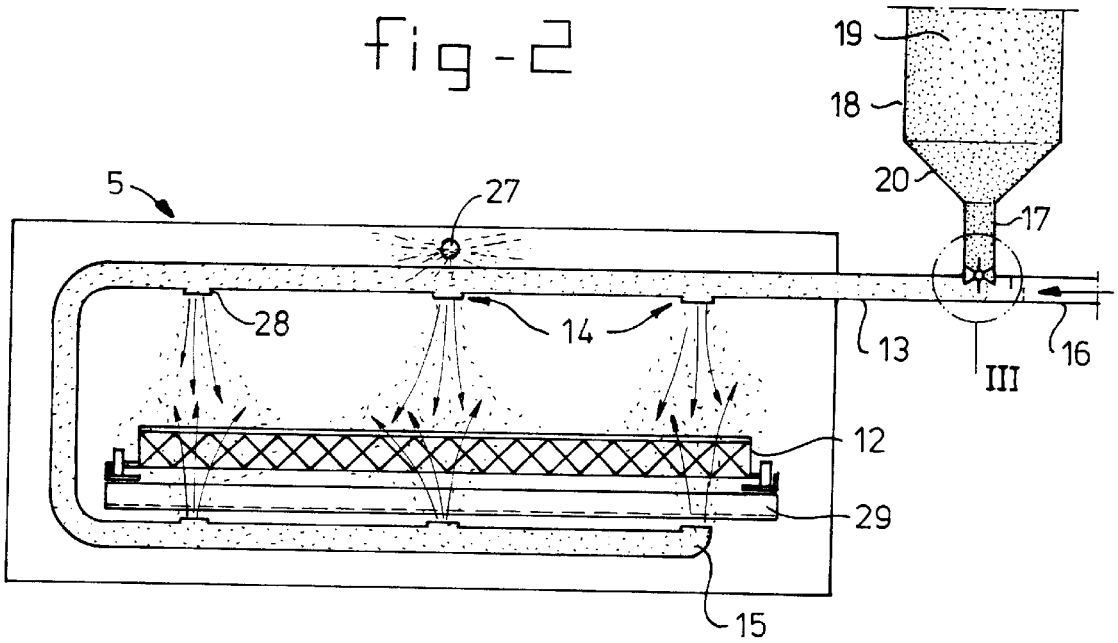
FIG. 2 shows a sectional view of the washing section of the device shown in FIG. 1.
Figure 3:
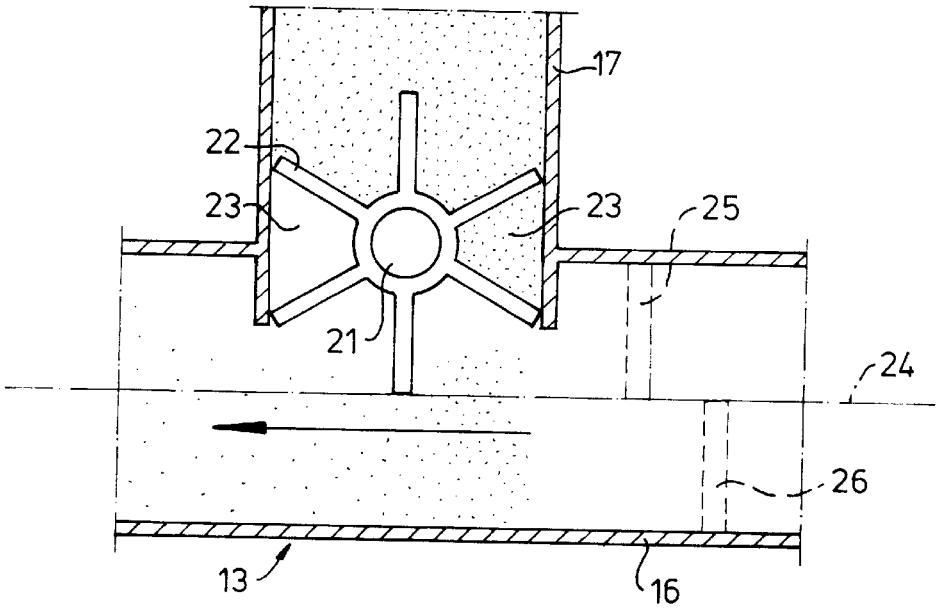
FIG. 3 shows a view of detail III in FIG. 2 on a larger scale.

With reference, now, to FIG. 2 and FIG. 3, a further description is given of how, in section 5 corresponding to a first advantageous embodiment, the powder-form cleaning composition is dispersed over the crockery. Section 5 is therefor shown in diagrammatic section in FIG. 2, a basket 12 being visible, which basket is filled with crockery in a manner not further described and which, in a manner known per se, is supported to be displaceable in the dish-washing machine 1. As shown, a hollow pipe 13 runs along the top, along the side and under the basket 12. Wing nozzles 14 are provided in the top and bottom portion of said hollow pipe 13, in the sidewall thereof, facing towards the basket 12. Preferably, the dimension of the internal diameter of the nozzle openings 14 is equal or substantially equal to the internal diameter of the hollow pipe 13. At its free end, the hollow pipe 13 is bent upwards towards the basket 12 and is open at said end 15, thus providing a wing nozzle 15 which corresponds to the wing nozzles 14. The various bends in the hollow pipe 13 are designed as uniformly as possible, with a bend radius of, preferably, at least the internal diameter of the pipe 13 in order to prevent undesired deposition of powder-form cleaning composition in the pipe 13 as far as possible. Furthermore, it is preferable for the pipe 13 to have no internal narrowing or widening, with the exception of the location of the wing nozzles 14. The hollow pipe 13 is connected to a blast device (not visible) at 16 in a manner which is not described in further detail. The blast device is, for example, suitable for forcing air at approximately 1.5 bar through the hollow pipe 13. As shown by means of the arrows, air is conveyed through the hollow pipe 13 and expelled out of the wing nozzles 14, 15. A feed channel 17 from a supply vessel 18 for powder-form cleaning composition 19 opens out between the end 16 and the wing nozzles 14 on one side of the hollow pipe 13. The supply vessel 18 becomes the feed channel 17 via a funnel-shaped transition section 20. The internal diameter of the feed channel 17 is preferably equal or substantially equal to the internal diameter of the hollow pipe 13. A paddle wheel 21 is installed in the feed channel 17. Said paddle wheel 21 has six paddles 22 which project radially and which are installed with an identical angular-distance distribution. The paddle wheel 21 is rotated clockwise in a manner which is not described in further detail by means of a drive unit, for example an electric motor, installed outside the feed channel 17 and the hollow pipe 13. Each paddle 22 is composed of a particularly wear-resistant, elastically flexible, for example rubbery, material. The length of each paddle 22 and the distance by which the feed channel 17 projects into the hollow pipe 13 are preferably sized so that two successive paddles 22, considered in the direction of rotation of the paddle wheel 21, form a sealed chamber 23 in conjunction with the respective inside wall of the feed channel 17, with which the respective paddles 22 engage. In this way, surprisingly, in a very expedient manner and with relatively simple means, the powder-form cleaning composition located in the supply vessel 18, the funnel-shaped transition part 20 and the feed channel 17, is reliably screened off from the hollow pipe 13 from the point of view of penetration of moisture and other possible contaminants, which could, for example, lead to coagulation of the powder-form cleaning composition with damaging consequences as regards even dispersal thereof. Furthermore, it is preferable to ensure that the paddles 22 project as far as the centre line 24 of the hollow pipe 13. Surprisingly, it has been found that, with the paddles 22 arranged in this manner, a particularly even distribution of the powder-form cleaning composition inside the hollow pipe 13 is achieved, by means of which a particularly satisfactory and even dispersal is achieved through the nozzles 14, 15, whilst the risk of settling of the powder-form cleaning composition in the pipe 13 and/or the nozzles 14, 15 is very limited or even completely prevented, meaning that reliable operation over a long period of time is guaranteed. It is probable that, by installing the paddle wheel 21 and the feed channel 17 so that they project by a short distance into the hollow pipe 13, a considerable degree of air turbulence is created in the pipe 13 whereby the powder-form cleaning composition is expediently sprinkled and is held in "suspension", without having the opportunity to form a deposit on the inside wall of the hollow pipe 13, for example directly underneath the paddle wheel 21. It will be clear that what is involved here is a connection between the sticky, mutually catching or dispersal properties of the powder-form cleaning composition, the size of the current of air through the hollow pipe 13, the internal diameter of the hollow pipe 13 and the internal dimension of the feed channel 17, the extent to which the feed channel 17 extends into the hollow pipe 13, and the distance by which a paddle 22 projects into the hollow pipe 13. Less advantageous, although also part of the invention, is an embodiment in which the feed channel 17 does not project into the hollow pipe 13, but the paddle wheel 21 is dimensioned in such a manner that the chambers 23 can be formed, sealed off from the environment, while a paddle 22 projects less far into the hollow pipe 13, for example by approximately half the distance to the centre line 24, or even does not project into the hollow pipe 13 at all, in which case, for example upstream of the feed channel 17, one or more baffles 25, 26 are arranged in the hollow pipe 13, restricting the free circulation surface area of the hollow pipe 13 and ensuring the desired air turbulence. For example, for this purpose, a baffle 25 may be provided so as to project into the pipe 13 from the top as far as the centre line 24. If appropriate, or in combination therewith, a baffle 26 may be arranged in a corresponding manner so as to project into the pipe 13 from the bottom as far as the center line 24. If a baffle 25, 26 should be arranged both at the top and at the bottom, it is preferable to stagger them over a sufficient distance so that sufficient air flow is guaranteed. From the standpoint of efficient production, however, the arrangement of the paddle wheel 21 shown in FIG. 3 and the projection of the feed channel 17 into the pipe 13 is preferred.

Furthermore, also in order to achieve a turbulence effect in the current of air to promote dispersal, a turbulence element, such as a screw part (not shown) may be incorporated upstream of the paddle wheel 21 in the air pipe 13 in order to create, for example, a spiral current in the pipe 13.

Figure 5:
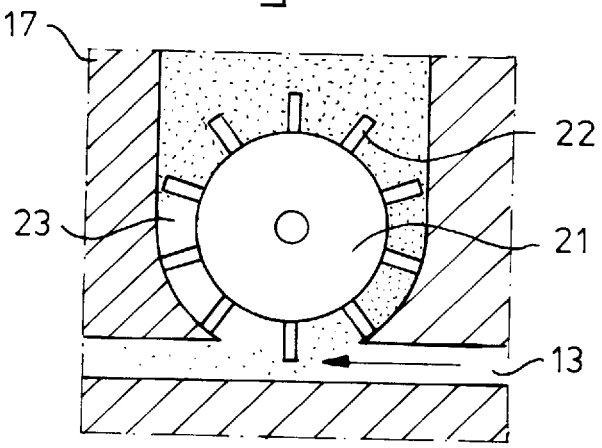
FIG. 5 shows a view, corresponding to FIG. 3, of a variant.

FIG. 5 shows an alternative paddle wheel 21. Said paddle wheel has ten paddles 22 distributed over the circumference. Metering, which is as smooth as possible, is thereby still further improved. Once again, the respective paddle 22 projects into the pipe 13 preferably by up to approximately half the diameter. Furthermore, the channel 17 has had its shape adapted on its side facing the pipe 13 and follows the contour described by the paddles 22 in order to achieve a still further improved seal against moisture.

Preferably, the volume of the metered amount can be adjusted by adapting the paddle length of the wheel 21. Preferably, by adapting the paddle width, it is possible to achieve adaptation to the diameter of the tube 13.

In addition to achieving a reliable seal, it is preferable to use a multi-blade paddle wheel 21, corresponding to FIG. 3 or FIG. 5, from the standpoint of a metering of the powder-form cleaning composition from the supply container 18 which fluctuates as little as possible over time. Obviously, more or fewer blades may also be used, for example four or eight. In choosing the number of blades, consideration should be given to a reliable action, even metering, optimum dispersal of the powder-form cleaning composition and simplicity of construction.

Obviously, according to the present invention, it is also possible to meter the powder-form cleaning composition into the hollow pipe 13 in a manner other than with a paddle wheel 21. The choice of the method of metering depends, for example, on the hygroscopic properties of the powder-form cleaning composition. If the hygroscopic properties are low a screw, driven in rotation and arranged in the feed channel 17 may also, for example, be chosen. In order to shield the powder-form cleaning composition located in the supply tank 18 against penetration of moisture, a screw of this type may be combined with a reliable seal against moisture, for example a controllable valve at the transition between the funnel 20 and the feed channel 17 which is closed each time the dish-washing machine 1 stops, whilst, after the dish-washing machine 1 stops, the screw continues to rotate until the feed channel 17 is completely free of powder-form cleaning composition, and only then does the air supply stop so that the hollow pipe 13 is blown completely empty. It will be clear that an alternative embodiment of this type is, however, more complicated.

As shown in FIG. 2, the hollow pipe 13 enters section 5 at the top and first of all runs along the top of section 5 and then along the bottom thereof. In connection with this, the supply container 18 should, for example, be arranged at the top of section 5. Although less advantageous, it is, however, also possible to run the hollow pipe 13 first of all along the bottom of section 5 and then upwards along a sidewall of section 5 in order, next, to end up running along the top. In this connection, it also possible to place the supply holder 18 at a low level. Furthermore, it is not absolutely necessary for metering of the powder-form cleaning composition, from the supply vessel 18, into the hollow pipe 13 to take place at a horizontal portion of the hollow pipe 13. It is also not absolutely necessary for the portion of the pipe 13 between the point of connection to the feed channel 17 and the first dispersal outlet 14, considered in the downstream direction from the feed channel 17, to be straight. However, it is preferable to exclude, as far as possible, any bends in that section of the pipe 13 and to keep it as even as possible. In that same connection, it is, naturally, also possible for the feed channel 17 to have a curved shape or a sloping position. However, from the standpoint of simplicity of construction and reliability of operation with maximum use of the action of gravity, the arrangement shown diagrammatically in FIG. 2 is preferred.

Figure 4:
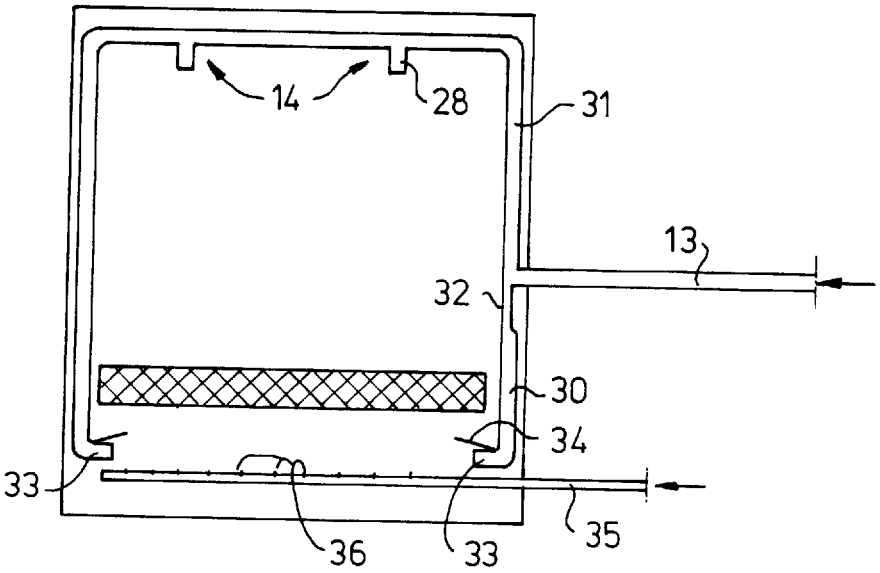
FIG. 4 shows a view, corresponding to FIG. 2, of a variant.
Figure 6:
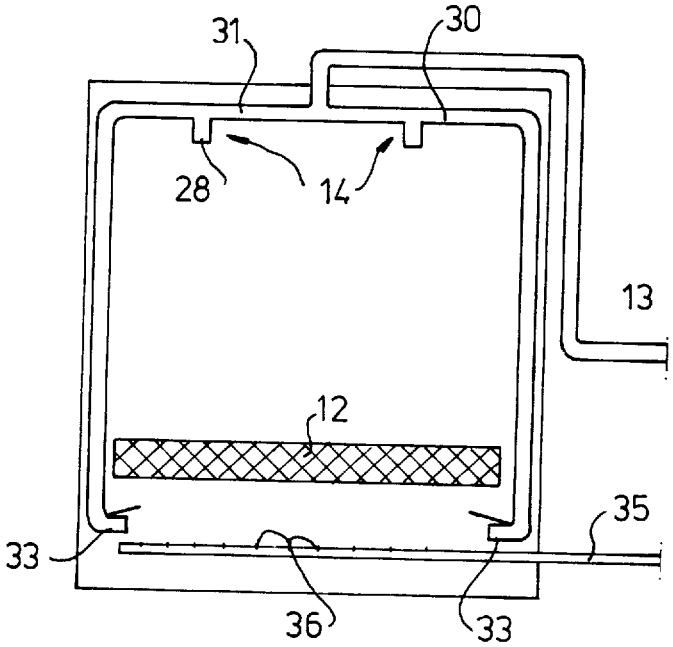
FIG. 6 shows a view, corresponding to FIG. 2, of a further variant.

FIGS. 4 and 6 show two further variants according to the invention. Only differences with respect to the embodiment according to FIG. 2 are shown here. Corresponding reference numerals refer to corresponding components. The supply holder 18, and so on, is not shown. Both FIG. 4 and FIG. 6 show how the pipe 13 branches into two portions 30 and 31. The branch 30 in FIG. 4 has a narrowing 32. This may be adjustable. In this manner, an even distribution of powder between the branches 30 and 31 is achieved, despite the difference in length. In FIG. 6, the branches 30 and 31 are essentially the same length, which guarantees even powder distribution. Each branch 30, 31 ends in a nozzle 33 which is directed sideways, underneath the basket 12. Directly above each nozzle 33, a screen element 34 has been provided in order to prevent, as far as possible, the penetration of any splashes of water. The presence of said element 34 is not essential. A gas supply pipe 35 runs under the nozzles 33. This pipe 35 has upward-facing openings 36 distributed over its length. In a working installation, powder from the nozzles 33 (and also 14) is dispersed principally horizontally, which powder is then conveyed upwards by the upwardly directed stream of gas from the nozzles 36 in order to reach the basket 12 and the crockery located therein. In this way, in a particularly effective manner, a balanced dispersal is achieved with minimal risk of moisture penetrating into the pipes 30, 31. Obviously, the course of the pipe 13 outside section 5 may also be different. FIG. 6 shows a path for the pipe 13 with which it is possible to use a supply vessel 18 (see FIG. 2) which is positioned relatively low.

Furthermore, a spray ball 27 is arranged inside section 5, preferably above the hollow pipe 13. This spray ball 27 is connected to a water supply pipe in a manner which is not shown in further detail. The spray ball 27 is usually inactive. However, as soon as the dish-washing machine 1 stops, for example at the end of the dish-washing cycle, when there is, for example, no more crockery in section 5, the spray ball 27 is used to sprinkle water in section 5 in order to lay the cloud of dust of powder-form cleaning composition formed in section 5 or to remove it in another way. Another suitable spray element, for example a spray arm with various spray nozzles distributed over its length, may also, of course, be chosen instead of a spray ball 27 arranged centrally with respect to the transverse dimension of section 5.

Practical tests have shown that a powder-form cleaning composition with a particle size in the region of 10 μm–400 μm can be dispersed as a particularly fine cloud. The currently most advantageous particle size is approximately 100 μm. It has been shown that, with the preferred embodiment shown in FIG. 2 and FIG. 3, no particular requirements have to be met in respect of the shape and/or the construction of the dispersal nozzles 14, 15 in order to achieve a fine cloud of dust of dispersed powder-form cleaning composition of this type. Holes of suitable diameter, preferably as large as the inside diameter of the hollow pipe 13, made in the relevant outside wall of the hollow pipe 13, appear, surprisingly, to yield satisfactory results. If appropriate, said openings in the hollow pipe 13 for the nozzles 14, 15 may be surrounded by flanges 28 which project somewhat from the outside wall of the hollow pipe 13, said flanges having a height of, for example, some tens of millimetres, preferably approximately twenty to twenty-five millimetres. It has been shown that, by using a flange 28 of this type, evenly distributed dispersal over all the openings 14, 15 can be achieved. In addition, in this way, satisfactory screening against penetration of splashes of water is achieved.

On the basis of an average transit speed of the crockery through the dish-washing machine 1, with a belt width of the conveyor belt of 50 cm, of approximately one m/min, it is preferable for the speed of rotation of the paddle wheel 21, depending on the volume of the chamber 23, to be adjusted in such a manner that a metering of approximately 1 kg per hour of powder-form cleaning composition is achieved, the flow rate of the air pump being adapted in such a manner that the hollow pipe 13 remains free of powder-form cleaning composition settling against the inside wall. It has been shown that, with an inside diameter of approximately 8 mm (expediency has shown this to be approximately 6 to 12 mm) of the hollow pipe 13 and an air pressure of 1.5 bar (0.5 bar overpressure) just upstream of the paddle wheel 21, using the five openings 14 and the one end opening 15 as shown in FIG. 2, the metering mentioned above in connection with the speed of the dish-washing machine 1 can be achieved. On the basis of this example, it will be clear to the expert how to calculate the setting for a dish-washing machine with another belt width and/or another speed of travel of the crockery through the dish-washing machine.

It has also been shown that satisfactory results can be obtained with an overpressure of approximately 0.2 to 1.0 bar just upstream of the paddle wheel 21.

In order largely to prevent said powder-form cleaning composition being able to accumulate in the hollow pipe 13, it is preferable, when starting up the dish-washing machine 1, firstly to start blowing air in via the end 16 of the hollow pipe 13 and to regulate this to the desired flow rate. The paddle wheel 21 is then set in motion and adjusted to the correct speed. If it is desired to stop the dish-washing machine 1 or to cease dispersal of the powder-form cleaning composition, the paddle wheel 21 is stopped first of all. Sometime afterwards, preferably more than approximately ten seconds later, the air supply at the end 16 of the hollow pipe 13 can then be stopped. If appropriate, it is possible to continue blowing air in via the end 16 in an uninterrupted manner and, for example, it is possible to stop it only for a short time, possibly during maintenance work or inspections. In this manner, water and moisture from section 5 is largely prevented from penetrating via the openings 14, 15 into the hollow pipe 13 in order, then, to reach the powder-form cleaning composition 19 in the feed channel 17, the funnel 20 and the supply vessel 18. In particular, this can be advantageous if a metering and sealing device has been chosen, which, in comparison with the six-blade paddle wheel 21, works less well.

Furthermore, in order to contain the cloud of dust of powder-form cleaning composition formed in section 5 inside said section 5, it is preferable, prior to starting metering of the powder-form cleaning composition from the feed channel 17 into the hollow pipe 13, to actuate the spray arms B in sections 4 and 6 so that, in this way, section 5 is efficiently sealed off from the environment by means of a water screen at the front and rear. Naturally, any inlet shutters or doors which may be installed in one or more walls of section 5, are provided with suitable seals, thereby preventing the cloud of dust of powder-form cleaning composition reaching the environment. In order effectively to shield the openings 14, 15 in the portion of the pipe 13 underneath the basket 12 against penetration of water droplets and the like, a V-shaped strip 29 has been arranged between said openings 14, 15 and the basket 12. Because of the V shape, dispersal from the lowermost openings 14, 15 is hindered as little as possible. If it is chosen to blow air in an uninterrupted manner through the pipe 13, a strip 29 of this type or equivalent provision may be omitted. After all, in that case it is guaranteed that air is continually blown out of the lowermost openings 14, 15 so that water has no opportunity to penetrate inside the pipe 13 via said lowermost openings 14, 15.

Clearly, yet further variants of the invention exist. Those applications which are based on combinations of the embodiments shown and described here or other applications based on the description and drawings given here and which are obvious to the expert come to mind. For example, the paddle wheel 21 may be replaced by two cylinder elements arranged principally horizontally and next to each other which can rotate in opposite directions. These define between them a narrow slit or nip, through which the powder is metered. In addition, simultaneous grinding of the powder is, for example, thereby obtained. By way of a variant of this, it is also possible, if appropriate, to use only one rotatable cylinder element, which determines a narrow slit with a portion of the wall of the channel 17, in order to meter the powder through it, into the pipe 13. In this case, also, it is possible, for example, to obtain grinding of the powder. Furthermore, it will be clear that, when use is made of the invention in a single-tank dish-washing machine (for example, for household use), any preliminary rinsing, the dispersal, washing, rinsing-off, final rinsing and drying take place in the same compartment, the crockery remaining stationary. The various nozzles for spraying and dispersal may then be arranged next to one another.

I claim:

1. A dish-washing process in a dish-washing machine comprising the following steps:

blowing a gas through a hollow pipe;

metering a cleaning composition in powder form into the pipe while the gas is blowing to disburse a cloud of the composition throughout a crockery containing portion of the dish-washing machine and over the crockery in such a manner that a surface of the crockery is at least partially covered with the cleaning composition;

subsequently exposing the crockery to a solvent to give said powder-form cleaning composition an operational form while said powder-form composition is still on the crockery; and when the process is to be stopped, stopping the metering of the composition before stopping the blowing of the gas through the pipe.

2. The process of claim 1, wherein the metering step comprises the step of dispensing the composition into the pipe with a paddlewheel whose paddles extend into the blowing gas in the pipe so as to cause the gas flow through the pipe to be turbulent.

3. The process of claim 2, wherein the paddles are extended into the pipe to about a middle of the pipe.

4. The process of claim 1, wherein the metering step comprises the step of covering the surface of the crockery with the composition.

5. The process of claim 4, wherein the step of giving the composition the operational form comprises the step of exposing the composition to a solvent.

6. The process of claim 5, wherein the solvent is water.

7. The process of claim 1, wherein the dish-washing machine in which the steps are carried out is a single tank dish-washing machine.

8. The process of claim 1, wherein that the operational form comprises at least 0.6% by weight of the cleaning composition.

9. The process of claim 8, wherein that the operational form comprises at least 20% by weight of the cleaning composition.

10. A dish washing process in a dish-washing machine comprising the steps of:

wetting crockery to be washed;

dispersing a dish cleaning powder into a first chamber of the dish-washing machine containing the crockery to be washed so that the dispersed powder is held in suspension throughout a crockery containing portion of the first chamber;

allowing the suspended powder to settle onto the crockery in the first chamber so that the crockery is at least partly covered with the powder;

at least partially dissolving the powder on the wetted crockery in the first chamber; and exposing the crockery that is at least partly covered with the powder to a solvent in a second chamber separated from the first chamber to give the powder an operational form while the powder is still on the crockery.

11. The process of claim 10, wherein the dispersing step comprises the step of covering the surface of the crockery with the powder.

12. The process of claim 10, wherein the powder comprises 10 to 400 $\mu$m particles.

13. The process of claim 10, wherein the step of exposing the crockery that is at least partly covered with the powder to a solvent in a second chamber occurs after the crockery has been covered with the powder for a predetermined time.

14. A dish washing process in a dish-washing machine comprising the steps of:

creating a turbulent flow of a gas through a pipe;

metering a dish cleaning powder into the flow of gas in the pipe;

dispersing the powder from the pipe into a first chamber of the dish-washing machine containing the crockery to be washed through plural nozzles so that the dispersed powder is held in suspension throughout a crockery containing portion of the first chamber;

allowing the suspended powder to settle onto the crockery in the first chamber so that the crockery is at least partly covered with the powder;

exposing the crockery that is at least partly covered with the powder to a solvent in a second chamber of the dish-washing machine separated from the first chamber to give the powder an operational form while the powder is still on the crockery.

15. The process of claim 14, wherein the metering step comprises the step of dispensing the powder into the pipe with a paddlewheel whose paddles extend into the pipe to about a middle of the pipe.

16. The process of claim 14, wherein the nozzles are directed toward the crockery from at least two sides of the first chamber.

17. A dish washing process in a dish-washing machine comprising the steps of:

forming a cloud of a dish cleaning powder throughout a crockery containing portion of a first chamber of the dish-washing machine containing the crockery to be washed;

allowing the powder in the cloud to settle onto the crockery in the first chamber so that the crockery is at least partly covered with the powder; and exposing the crockery that is at least partly covered with the powder to a solvent to give the powder an operational form while the powder is still on the crockery.

18. The process of claim 17, wherein the exposing step takes place in a second chamber of the dish-washing machine separated from the first chamber.

19. The process of claim 17, further comprising the steps of wetting the crockery before allowing the powder in the cloud to settle onto the crockery, and at least partially dissolving the powder on the wetted crockery in the first chamber before exposure to the solvent.

20. The process of claim 17, wherein the steps are carried out in a single tank dish-washing machine.

21. A dish washing process in a dish-washing machine comprising the steps of:

forming a cloud of a dish cleaning powder throughout a crockery containing portion of a first chamber of the dish-washing machine by ejecting the powder from one or more nozzles directed inside the first chamber;

allowing the powder in the cloud to settle onto the crockery in the first chamber so that the crockery is at least partly covered with the powder; and exposing the crockery that is at least partly covered with the powder to a solvent to give the powder an operational form while the powder is still on the crockery.

22. The process of claim 21, wherein the powder is ejected from a plurality of the nozzles from at least two sides of the first chamber.

23. An improved dish washing process for a dish-washing machine in which crockery is sequentially moved through washing stages and in one of the stages is doused with washing water containing a dissolved dish washing composition from a previous stage, the improvement comprising the steps of:

forming a cloud of the dish washing composition in powder form throughout a first chamber of the dish-washing machine containing the crockery to be washed and allowing the powder in the cloud to settle onto the crockery in the first chamber so that the crockery is at least partly covered with the composition in powder form; and exposing the crockery that is at least partly covered with the composition in powder form to water in a second chamber of the dish-washing machine separate from the first chamber to give the composition an operational form while the composition is still on the crockery;

collecting the water from the exposed crockery which contains the dissolved dish washing composition in the second chamber; and providing the collected water to a subsequent stage of the dish-washing machine for dousing the crockery.

24. A dish washing process in a dish-washing machine in which a stream of crockery to be washed is moved downstream through preliminary rinsing, cleaning and rinsing sections of the dish-washing machine, comprising the steps of:

prewetting the crockery with a liquid film in the preliminary rinsing section of the machine;

dispersing a dish cleaning composition in powder form to form a cloud of the composition throughout a crockery containing portion of the cleaning section of the machine;

allowing the composition in the cloud to settle onto the crockery so that the crockery in the cleaning section is at least partially covered with the composition;

dissolving the composition in the liquid film on the crockery to give the composition an operational form so that at least one dish cleaning component of the composition has a concentration of at least 0.6% by weight; and removing the composition from the crockery in the rinsing section.

25. The process of claim 24, wherein the operational form comprises at least 20% by weight of the one dish cleaning component.

* * * * *